US007086558B1

(12) United States Patent
Pixley et al.

(10) Patent No.: US 7,086,558 B1
(45) Date of Patent: Aug. 8, 2006

(54) TOOL VENDING MACHINE AND METHOD THEREFORE

(75) Inventors: Stephen M. Pixley, Huntington Beach, CA (US); Charles J. Schurter, Orange, CA (US); James J. McMahon, Long Beach, CA (US)

(73) Assignee: Autocrib, Incorporated, Santa Ana, CA (US)

( * ) Notice: Subject to any disclaimer, the term of this patent is extended or adjusted under 35 U.S.C. 154(b) by 164 days.

(21) Appl. No.: 10/791,991

(22) Filed: Mar. 2, 2004

(51) Int. Cl.
*G07F 11/00* (2006.01)

(52) U.S. Cl. ..... 221/9; 221/2; 221/7; 221/277; 221/241

(58) Field of Classification Search ..... None
See application file for complete search history.

(56) References Cited

U.S. PATENT DOCUMENTS 4,391,388 A * 7/1983 Krakauer ..... 221/76
4,519,522 A 5/1985 McElwee
4,598,810 A 7/1986 Shore et al.
4,961,507 A 10/1990 Higgins
5,169,027 A * 12/1992 Falk et al. ..... 221/2
5,205,436 A 4/1993 Savage
5,337,920 A 8/1994 Clausen

OTHER PUBLICATIONS http://www.autocrib.com/releases.asp?r=6 □□Bruce Weaver, "Autocrib Releases the Robocrib Model "C" Carousel System", Jan. 10, 2003, Autocrib.*

* cited by examiner

*Primary Examiner*—Gene O. Crawford
*Assistant Examiner*—Timothy Waggoner
(74) *Attorney, Agent, or Firm*—Jack C. Munro

(57) ABSTRACT

A tool vending machine which permits human access to only a single size compartment of a plurality of different sized compartments at a time so that the user is only able to extract a tool that is contained within that single compartment and does not permit access to any other compartment. The particular compartment is to be manually selected by the human user.

9 Claims, 4 Drawing Sheets

TOOL VENDING MACHINE AND METHOD THEREFORE

BACKGROUND OF THE INVENTION

1. Field of the Invention

The field of this invention relates to a vending machine and more particularly to a vending machine which is designed to dispense tools.

2. Description of the Related Art

Manufacturers commonly employ machinists. These machinists use tools. Typical tools will be drill bits, saw blades, socket drivers, chisels and the like. There are literally hundreds of different tools that are commonly used by machinists in manufacturing facilities.

In the past, it has been common for these machinists to go to a supply room for such tools and select whatever tool that they wanted and then go ahead and use the tool accordingly. The problem with this type of arrangement is that the tool never gets back to the supply room and actually the ends up probably going home with the machinist to stockpile the machinist's home tool supply.

It has been common within manufacturing plants to overcome this problem by establishing a tool crib. The tool crib is manned by an employee. That employee is required to sign out the tool to the machinist, and if the machinist does not bring back the tool to the tool crib, then the expense of that particular tool will then be charged to the machinist. This will cause the machinist to make sure that the tool gets back to the supply room.

The problem with the tool crib is that it has to be manned by an employee and therefor is inherently expensive. Within recent years, there is known a vending machine for tools which will eliminate the cost of an employee. The machinist will go to the vending machine, program in his or her code, make the selection for the type of tool that he or she wants and then that particular tool will be dispensed to the machinist. When the machinist is finished with the tool, the machinist will bring it back and and then put the tool back into the vending machine at the same location from which the tool was extracted. The vending machine will record what tool has been charged to what individual and keep a record of whether that tool is returned or not. If the tool is not returned, then the expense of the tool can then be charged to the machinist.

However, there is one significant deficiency of the tool vending machine that has been previously constructed. That deficiency is that there is no consideration being given to the size of the tool that is being dispensed. Some tools can be rather large in size while other tools can be quite small in size. The vending machines that have been used in the past utilize a series of carousels. Each carousel is divided into a series of vertically spaced apart trays. Each tray is divided into a series of compartments. In the past, the compartments were all the same size on a particular level of the carousel. It really doesn't make much sense to locate a one-eighth inch diameter and two to three inches in length drill bit in the same size compartment that there may be a one-inch diameter and six to eight inches in length drill bit. The one-eighth inch diameter drill bit occupies only a small space of the compartment where the one-inch diameter drill bit could substantially be almost as long as the compartment is wide.

The vending machine causes movement of the carousel to the area of a door and then the door is opened for the particular selected tool that permits the machinist to gain access to a single compartment. The maximum width of the compartment is generally equal to the maximum width of the door opening so that the machinist can only gain access to that compartment and not to any other directly adjacent compartments. However, if one decides to make the compartment smaller so that smaller tools can be located in the smaller compartment and the same size door opening is utilized, the machinist is able to stick his or her hand into compartments located on each side of the selected compartment and remove tools from those compartments. This, of course, is not desirable.

The usage of smaller compartments is definitely desirable as a single vending machine can be utilized to dispense a greater quantity of tools. A vending machine with smaller compartments can dispense two to three times the tools of a vending machine that only has large compartments. However, the vending machine must be modified so that the door opening can be varied in size to accommodate larger width compartments and also smaller width compartments.

SUMMARY OF THE INVENTION

The first basic embodiment of tool vending machine of the present invention utilizes a housing having a sidewall which encloses an internal chamber. A door is mounted in the sidewall with the door being located within a door opening formed in the sidewall. The door is pivotally movable relative to the housing. At least one first compartment is located within the internal chamber and at least one second compartment is located within the internal chamber. The second compartment is defined as being larger in size than the first compartment. A drive mechanism is included for moving the first compartment and the second compartment with this drive mechanism being located within the internal chamber. The drive mechanism is to move the first compartment and the second compartment to be located directly adjacent the door to permit manual access into the compartment by opening of the door. Only a single compartment is to be aligned with the door at a time. A user interface tool selection means is incorporated that is mounted on the sidewall of the housing. The selection means permits manual selection of either the first compartment or the second compartment to be moved to be in alignment with the door. The door also includes a baffle means with this baffle means also being mounted within the internal chamber. The baffle means is to be movable to change the size of the door opening so that the door opening corresponds in size with the size of the compartment that is aligned with the door.

A further embodiment of the present invention is where the first basic embodiment is modified by there being included a plurality of doors within the door vending machine.

A further embodiment of the present invention is where the first basic embodiment is modified by there being included a plurality of the first compartments.

A further embodiment of the present invention is where the first basic embodiment is modified by there being a plurality of second compartments.

A further embodiment of the present invention is where the first basic embodiment is modified by the drive mechanism being defined as a rack and pinion gear assembly.

A further embodiment of the present invention is where the first basic embodiment is modified by the baffle means being defined as a pair of plates which are movable simultaneously in opposite directions.

A further embodiment of the present invention is where the just previous embodiment is modified by the plates being directly adjacent the door.

A second basic embodiment of the present invention is directed to a tool vending machine which utilizes a bin carousel assembly that has a plurality of different size compartments with this bin carousel assembly being mounted within an internal chamber of a housing. There is also included a user interface tool selection means for selecting a compartment to be moved directly adjacent to and in alignment with a door mounted within the housing. There is also included a baffle assembly mounted in conjunction with the door with the baffle assembly to automatically adjust the size of the door opening to correspond to the size of the compartment with it being understood that only a single compartment can be aligned with the door at a time eliminating access to compartments that are located directly adjacent the selected compartment. The baffle assembly comprises a pair of plates.

A further embodiment of the present invention is where the second basic embodiment is modified by including a plurality of carousels within the bin carousel assembly.

A further embodiment of the present invention is where the second basic embodiment is modified by defining the plates as a pair of plates moving in opposite directions.

A third basic embodiment of the present invention is directed to a method of automatically extracting a tool from a compartment with there being available a plurality of different size compartments comprising the steps of manually selecting the tool, moving the compartments until a desired compartment is located to be manually accessible through an opening formed in a housing which is normally closed by a door, automatically adjusting the size of the opening to correspond to the size of the compartment only permitting the user to extract the tool from that compartment and not permitting access to any directly adjacent compartment and the step of automatically adjusting is accomplished by moving a plate assembly to restrict or enlarge the opening.

A further embodiment of the present invention is where the third basic embodiment is modified by defining of the plate assembly as a pair of plates movable in opposite directions.

A third basic embodiment of the present invention is directed to a method of automatically extracting a tool from a compartment with there being available a plurality of different size compartments comprising the steps of manually selecting the tool, moving the compartments until a desired compartment is located to be manually accessible through an opening formed in a housing which is normally closed by a door, automatically adjusting the size of the opening to correspond to the size of the compartment only permitting the user to extract the tool from that compartment and not permitting access to any directly adjacent compartment.

A further embodiment of the present invention is where the third basic embodiment is modified by mounting of the compartments on a series of bin carousels where each carousel has only a single size of compartments.

A further embodiment of the present invention is where the third basic embodiment is modified by moving of the plate assembly to restrict or enlarge the opening that is associated with the door.

A further embodiment of the present invention is where the just previous basic embodiment is modified by defining of the plate assembly as a pair of plates movable in opposite directions.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

The present invention is utilized in conjunction with a rotary carousel-style storage and retrieval parts bin inventory machine which is basically disclosed within U.S. Pat. No. 5,337,920. Typically, this type of machine will have several different levels of carousels, usually fifteen levels. This type of vending machine is in common use as an automated vending machine for industrial users to dispense tools. The machine of this patent provides authorized users secure access to a requested tool by way of a touch screen computer interface. There is controlling computer software that validates the user's request against a preset security and stock level parameters, and once the user is approved, the carousel controller rotates the carousel to locate a compartment of the bin carousel directly adjacent an openable door of the inventory machine.

Figure 1:
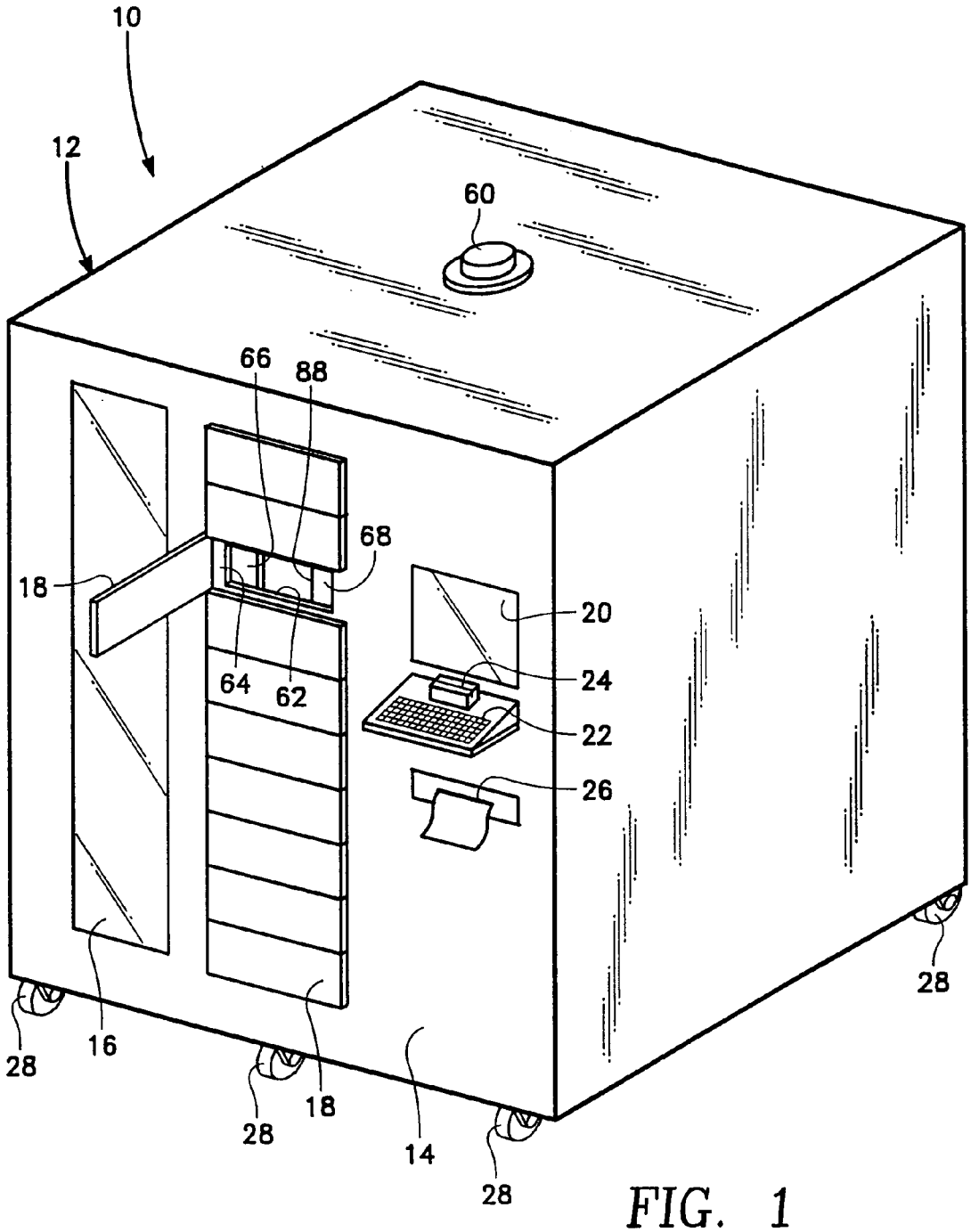
FIG. 1 is a frontal exterior isometric view of a typical vending machine that is constructed in accordance with this invention.

Referring particularly to FIG. 1, there is shown vending machine 10 of this invention which includes a box-like metal sheet material housing 12. The housing 12 includes a front wall 14. Within the front wall 14 is a transparent viewing window 16. Alongside the viewing window 16 is a series of doors 18. Each door 18 is capable of being opened separately from the other doors 18. The normal position for the doors 18 will be locked and are not capable of being opened. The door is only openable when actuated by a computer. Also included within the housing 12 is a computer screen 20. Mounted directly adjacent the computer screen 20 is a computer keyboard 22. Mounted in conjunction with the keyboard 22 is a card reader 24. Also mounted within the front wall 14 and located near the keyboard 22 is a receipt ejection slot 26. The entire vending machine 10 can be placed on caster wheels 28.

Figure 8:
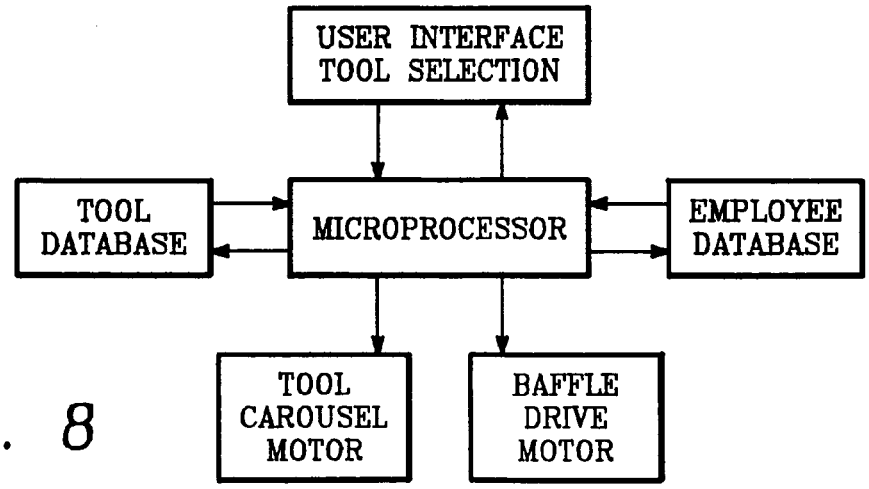
FIG. 8 is a block diagram of the electronics that are utilized in conjunction with the vending machine of the present invention.

Referring particularly to FIG. 8, there is included electronics within the vending machine 10. This electronics includes a microprocessor. Employee information can be supplied to the microprocessor with this employee information being contained within an employee data base. Also to be supplied to the microprocessor is information on the different tools that are contained within the vending machine 10 and therefore there is a tool data base to which the microprocessor is connected. The selection of the desired tool to be obtained is permitted by the user inserting a plastic card, which has been issued to the particular user, within the card reader 24. This will activate the entire system and then the user, by typing in by the computer keyboard 22, can select which tool the user wishes to procure. The keyboard 22, in conjunction with the card reader 24, is referred to in FIG. 8 as the user interface tool selection. Once the desired selection has been made, the microprocessor will cause activation of a tool carousel motor and a baffle drive motor. The baffle drive motor is mounted within a baffle drive motor housing 30. This housing 30 is shown in FIGS. 4–7.

Inside the housing 12 is an internal chamber 32. Each of the doors 18 is pivotally mounted by a hinge 34 to the front wall 14. Located within the internal chamber 32 is a first carousel 36, a second carousel 38 and a third carousel 40. It is to be understood that in actual practice there may be included substantially more than the three in number of carousels shown. Also, it is considered to be within the scope of this invention that there could be any number from one to several such carousels.

Each carousel includes a series of tray levels 42. There will be an equal number of tray levels 42 to the number of doors 18. In FIG. 1, there is shown ten in number of the doors 18. Therefore, each carousel will include ten in number of the tray levels 42 in a stacked relationship. In actual practice, the vending machine 10 will have, in most instances, more than ten tray levels 42. Each tray level 42 is basically circular in configuration and all the tray levels 42 for each carousel are mounted on a center shaft 44 for carousel 36, a center shaft 46 for carousel 38 and a center shaft 48 for carousel 40. Each of the center shafts 44, 46 and 48 are connected together by a series of links 50, 52 and 54 to a plate 56. The plate 56 is attached to a mounting post 58 which in turn is supported in conjunction with the housing 12. The mounting post 58 is connected to a cap 60 that is fixedly mounted on the housing 12.

Included within the internal chamber 32 is an appropriate drive mechanism, which is not shown, that will drive the carousels 36, 38 and 40 altogether. It is the function to locate one of the carousels 36, 38 and 40 directly adjacent door opening 62 with it being understood that there is a separate door opening 62 for each door 18. Each door opening 62 is surrounded by a door frame 64.

Mounted within the internal chamber 32, and in conjunction with the door frames 64 and located directly adjacent the door openings, are a pair of baffle plates 66 and 68. Each baffle plate 66 and 68 extends the entire length of all the doors 18. Baffle plate 66 is connected to a rack gear 70 and baffle plate 68 is connected to a rack gear 72. Each of the rack gears 70 and 72 are mounted in conjunction with a pinion gear 74. The pinion gear 74 is mounted on a motor shaft 76 which is connected to a motor which is mounted within the baffle drive motor housing 30. In actual practice, there may be located a pair of rack and pinion gear assemblies mounted at each end of the plates 66 and 68 or there may be utilized just a single rack and pinion gear assembly. The drive motor, which is not shown, that is mounted within the baffle drive motor housing, is capable of operating in either the forward or reverse direction, as indicated by arrows 78 and 80 in FIGS. 6 and 7.

Let it be assumed that a human user has made a tool selection by using the user interface tool selection of FIG. 8. The information is transmitted to the microprocessor and from the microprocessor the information is transmitted to the carousels 36, 38 and 40. The carousels 36, 38 and 40 are then rotated so that the particular carousel 36, 38 and 40 that carries the selected tool is located directly adjacent the door opening 62. Observing of the carousels 36, 38 and 40 in FIGS. 2 and 3, it can be seen that the tray level 42 of carousel 38 is divided into a series of small, pie shaped, compartments 82 (twelve in number) with the first carousel 36 being divided into a series of intermediate sized, pie shaped, compartments 84 (six in number) and each tray level 42 of the third carousel 40 being divided into large sized, pie shaped, compartments 86 (three in number). It is considered to be within the scope of this invention that the size of the compartments can readily change to be larger or smaller as per what is desired to be manufactured. It is also considered to be within the scope of this invention that although in most instances the carousel 38 will include only small compartments 82 with carousel 36 only including intermediate size compartments 84 and carousel 40 including only large size compartments 86 that each carousel in and of itself may include different size compartments on different tray levels 42. The compartments 86 are designed to carry a larger size tool with compartments 84 being designed to carry only a medium size tool and compartment 86 designed to carry only a small tool.

Figure 3:
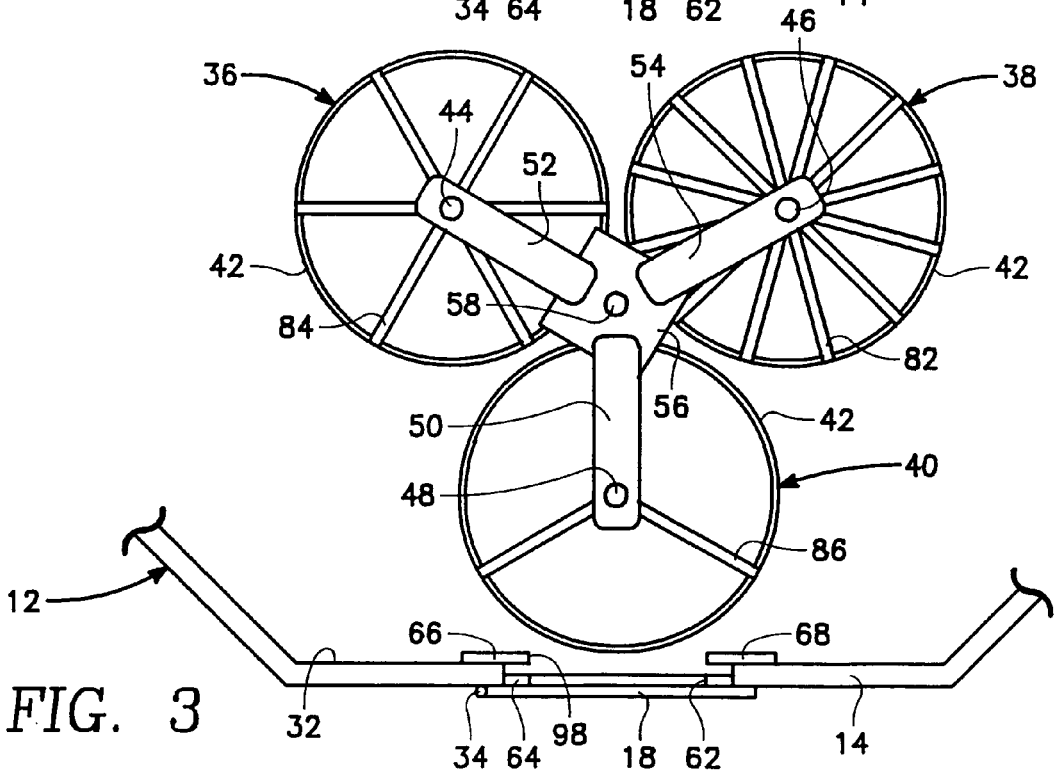
FIG. 3 is a view similar to FIG. 2 but showing the baffle arrangement for the door in the largest size configuration.
Figure 4:
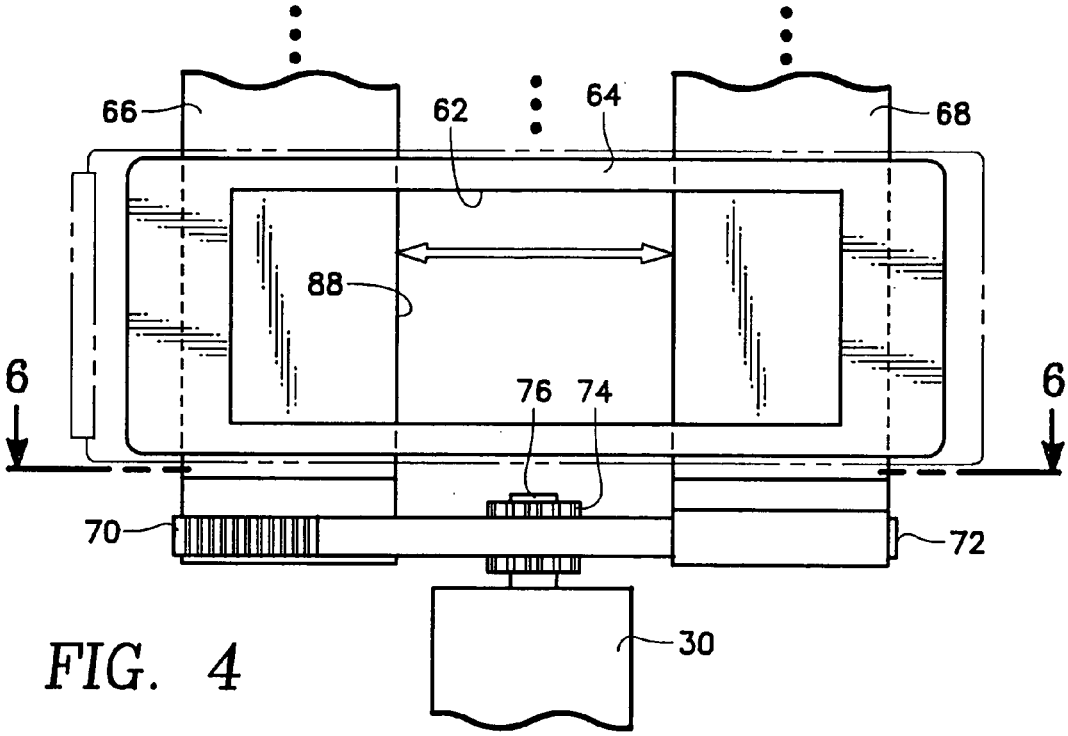
FIG. 4 is a side elevational view showing the rack and pinion gear assembly that is usable in conjunction with the baffle assembly and showing the baffle assembly in the position of FIG. 2.
Figure 5:
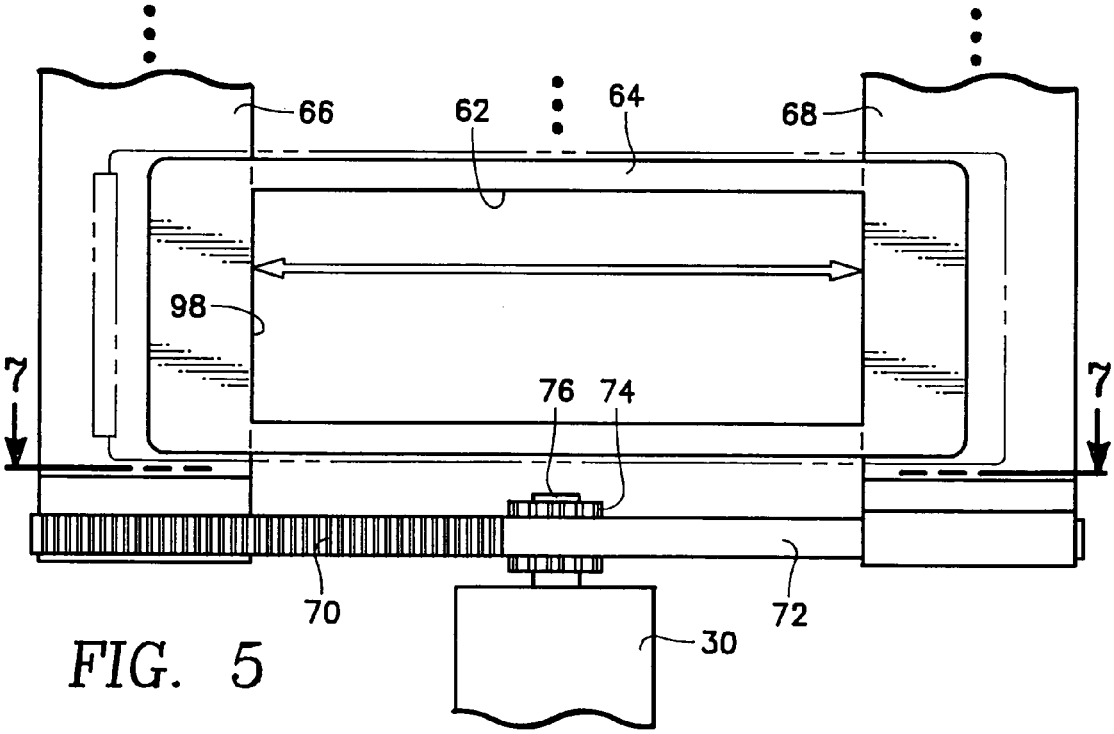
FIG. 5 is a view similar to FIG. 4 but where the baffle assembly is in the position shown in FIG. 3.

Let it be assumed that the user has selected a large tool. This will mean that the carousel 40 will be moved in connection with the door opening 62, which is shown in FIG. 3. In this position, the maximum width of the door opening 62 can be used because the greatest width of the pie-shaped segment of the compartment 86 is greater than the width of the door 62. In this position, the pinion gear 74 is caused to rotate in the direction of arrow 80 which causes the racks 70 and 72 to move linearly in the direction of arrows 94 and 96, respectively, moving the baffle plates 66 and 68 simultaneously in opposite directions away from each other to occupy the maximum opening or widest spaced-apart position 98, shown in FIGS. 3 and 7. The door 18 for the particular selected compartment 86 will automatically pop open. The user places his or hand within the compartment 86 and extract the tool that has been selected. The user also extracts a written receipt from the slot 26 which gives the user a written record of what tool is selected, what door and carousel is its home and the time and day of selection. The user then shuts the open door 18 and then proceeds to use the tool as desired. After the user no longer has any need for the tool, the user is to bring the tool back to the vending machine 10, again insert his or her card within the card reader 24 and program in again the selection for the tool that was originally made only indicating that at this time the user is returning the tool. The carousel will again move so that the particular compartment 86 is aligned with the door 18 that is again popped open that permits the user to return the tool to the compartment and then shut the door 18. This means that the tool is now available to be accessed by other users.

Figure 2:
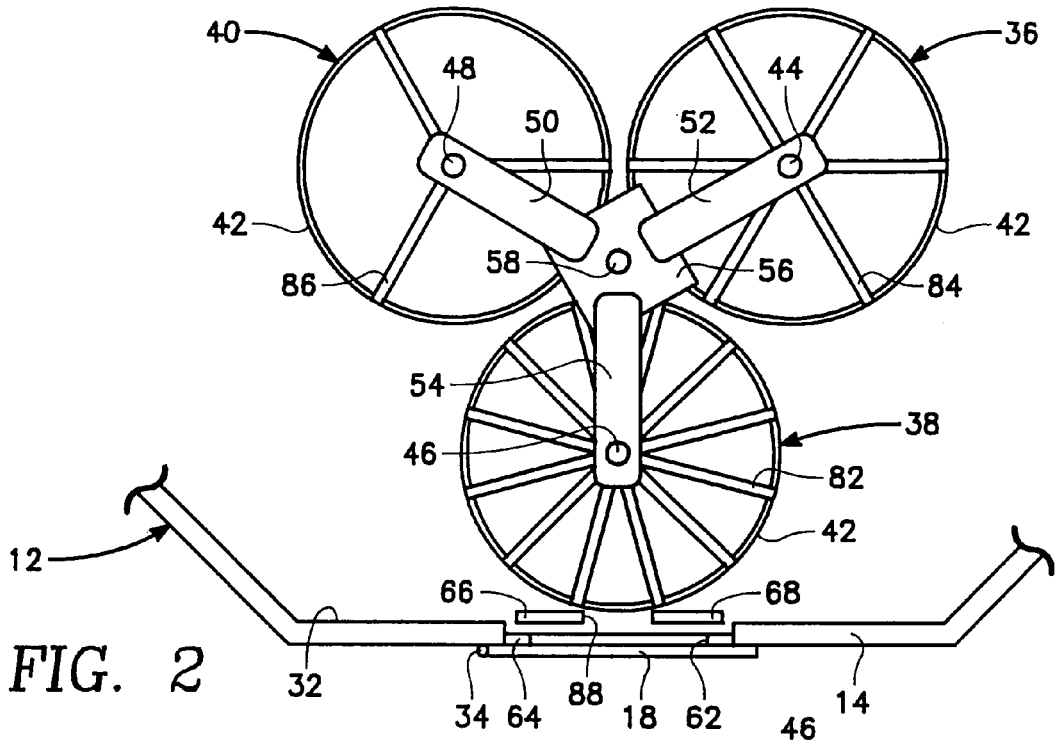
FIG. 2 is a top plan view of a portion of the internal components of FIG. 1 showing the location of bin carousels within the vending machine and also showing the relation of the bin carousels to the door baffle arrangement of this invention showing the door baffle arrangement in a position to produce a minimum size door opening to accommodate to the smallest size compartment within the bin carousel assembly.
Figure 6:
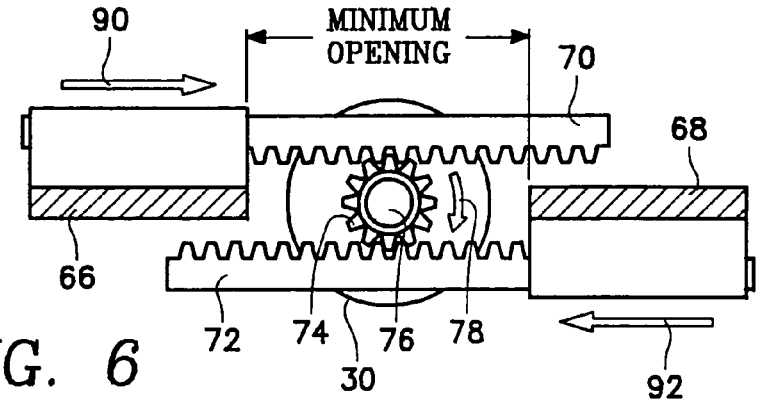
FIG. 6 is a cross-sectional view taken along line 6—6 of FIG. 4.
Figure 7:
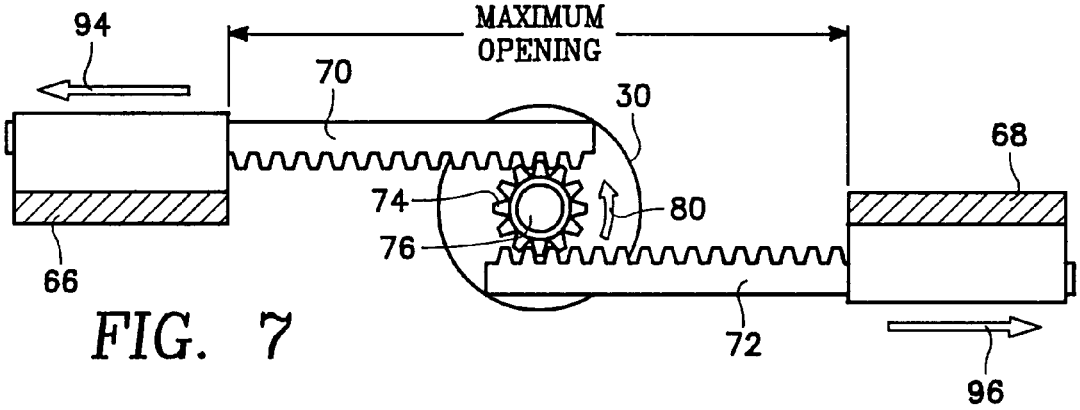
FIG. 7 is a cross-sectional view taken along line 7—7 of FIG. 4.

Let's assume that the user wishes to utilize a small size tool that is located within one of the compartments 82. The user again makes the selection on the keyboard 22 by inserting his or her card within the card reader 24. The carousels will automatically rotate until the second carousel 38 is located directly adjacent the door opening 62, which is shown in FIG. 2 of the drawings. At the same time that the carousels are doing this movement, the pinion gear 74 is rotated in the direction of arrow 78 which causes the racks 70 and 72 to move linearly moving the baffle plates 66 and 68 toward each other to occupy a minimum opening position, which is shown in FIGS. 2 and 6. This minimum opening is defined as opening 88.

Again, the particular door 18 for the particular selected compartment 82 is automatically popped open and the user is to place his or her hand through the opening 88 into the compartment 82 and extract the selected tool. It is to be noted that because of the movement of the baffle plates 66 and 68 that the user is only able to gain access to one compartment 82 and not able to gain access to the two compartments that are located on each side of the selected compartment 82. The baffle plates 66 and 68 are moved toward each other in direction of arrows 90 and 92 in FIG. 6 in order to achieve the minimum open position of FIG. 6.

It is to be understood that a similar technique can be utilized in order to gain access to the intermediate size compartments 84 of the first carousel 36. At that particular time, the baffle plates 66 and 68 will occupy an intermediate position smaller than the maximum size opening of FIG. 7 but larger than the minimum size opening of FIG. 6.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be added for the device described, but also a method claim is added to address the method of making the invention. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A tool vending machine comprising:

a housing having a sidewall which encloses an internal chamber, a door mounted in said sidewall, said door being located within a door opening formed in said sidewall, said door being pivotally movable relative to said housing;

at least one first compartment located in said internal chamber;

at least one second compartment located in said internal chamber, said second compartment being larger in size than said first compartment;

a drive mechanism for moving said first compartment and said second compartment, said drive mechanism being located within said internal chamber, said drive mechanism to move said first compartment and said second compartment to be located directly adjacent said door to permit manual access into said compartment by opening of said door, only a single said compartment to be aligned with said door at a time;

a user interface tool selection means mounted on said sidewall, said user interface tool selection means to permit manual selection of either said first compartment or said second compartment to be moved in alignment with said door; and baffle means mounted on said housing and located within said internal chamber, said baffle means to be movable to change size of said door opening so said door opening corresponds in size with the size of said compartment that is aligned with said door, said baffle means being movable by a rack and pinion gear assembly, whereby when a said compartment is aligned with said door and said door is opened a person is permitted to exact a tool contained within said compartment and only that compartment.

2. The tool vending machine as defined in claim 1 wherein:

there being a plurality of said doors.

3. The tool vending machine as defined in claim 1 wherein:

there being a plurality of said first compartments.

4. The tool vending machine as defined in claim 1 wherein:

there being a plurality of said second compartments.

5. The tool vending machine as defined in claim 1 wherein:

said baffle means comprising a pair of plates movable simultaneously in opposite directions.

6. The tool vending machine as defined in claim 5 wherein:

said plates being mounted on said sidewall directly adjacent said door.

7. A tool vending machine comprising:

a bin carousel tray assembly that has a plurality of different size compartments, said bin carousel tray assembly being mounted within an internal chamber of a housing;

a user interface tool selection means for selecting a compartment of said compartments to be moved directly adjacent to and in alignment with a door mounted in said housing; and a baffle assembly mounted in conjunction with said door, said door defining an opening, said baffle assembly to automatically adjust size of said opening to correspond to size of said compartment with it being understood that only a single said compartment can be aligned with said door at a time, said baffle assembly being movable by a rack and pinion gear assembly, said baffle assembly comprising a plurality of plates.

8. The tool vending machine as defined in claim 7 wherein:

said bin carousel assembly comprising a plurality of carousels with each said bin carousel tray containing only compartments of a given size and where each said bin carousel contains a different size compartment.

9. The tool vending machine as defined in claim 7 wherein:

said plurality of plates actually comprising a pair of plates which are movable simultaneously in opposite directions.

* * * * *